US006637395B1

(12) United States Patent
Olson et al.

(10) Patent No.: US 6,637,395 B1
(45) Date of Patent: Oct. 28, 2003

(54) KICK STARTER ASSIST SYSTEM

(76) Inventors: Ronald E. Olson, 7945 Eight Mile Creek Rd., Pensacola, FL (US) 32526; Jeffrey R. Albrecht, Sr., 3601 Forest Glen Dr., Pensacola, FL (US) 32504; George W. Brewton, Jr., 3007 N. T St., Pensacola, FL (US) 32505

( * ) Notice: Subject to any disclaimer, the term of this patent is extended or adjusted under 35 U.S.C. 154(b) by 0 days.

(21) Appl. No.: 10/090,504

(22) Filed: Mar. 4, 2002

(51) Int. Cl.[7] ..... F02N 11/08
(52) U.S. Cl. ..... 123/179.3
(58) Field of Search ..... 123/179.3, 179.24, 123/179.25, 179.26

(56) References Cited

U.S. PATENT DOCUMENTS 6,109,121 A * 8/2000 Brown ..... 123/179.24

* cited by examiner

*Primary Examiner*—Henry C. Yuen
*Assistant Examiner*—Arnold Castro
(74) *Attorney, Agent, or Firm*—Peter Loffler

(57) ABSTRACT

A kick start assist system uses a standard motorcycle kick starter that is installed onto the motorcycle and which kick starter turns the motorcycle's engine over which engine turning is detected by the kick start assist system and which causes the system to energize the standard electrical starting system of the motorcycle in order to start the engine of the motorcycle.

14 Claims, 1 Drawing Sheet

KICK STARTER ASSIST SYSTEM

BACKGROUND OF THE INVENTION

1. Field of the Invention

The present invention relates to an assist system that uses a motorcycle kick starter to assist the electrical starting system of a motorcycle to start the motorcycle engine.

2. Background of the Prior Art

Some time ago, almost all motorcycles where started by the use of a kick starter. A rider mounted the motorcycle and engaged the kick starter with one of his feet, typically the right foot as most kick starters were located on the starboard side of the motorcycle. Then with a downward thrust of the leg, the kick starter was also thrust downwardly which caused, hopefully, the motorcycle's engine to fire up. Oftentimes, several starting attempts were necessary in order to start the motorcycle. This was often the case when the motorcycle was not properly tuned, when the rider lacked sufficient lower body strength, or when the rider simply did not know how to properly kick start a motorcycle.

As time progressed, the electric starter was born. The rider simply mounted the motorcycle, turned the ignition switch, typically, via a key, to the on position, and pressed a starter button. The starter button dispatched a signal to-a starter relay which activated a starter solenoid which turned the starter motor, thereby cranking the motorcycle. The electric starter system had the advantage that neither body strength, nor kick start capability, played a role in starting the motorcycle. The rider simply had to push a button in order to be on the road. The main disadvantage that is associated with an electric starting system is the need for the source of electric power. A larger size motorcycle can require a battery that has upwards of 300 amps of draw power in order to start the engine. As motorcycles are relatively compact vehicles, such a battery can take up valuable real estate as well as adding to the overall weight of the motorcycle.

One other drawback associated with electric start motorcycles, while not tangible from a mechanical point of view, is the loss of prestige that many riders experience from simply pushing a button as opposed to kick starting a motorcycle. Many view the kick starter as an essential element of a true rider's arsenal and an electric starter as another "gimmick" of the yuppie generation. Many a true fan would not be caught dead pushing buttons in order to start their chopper.

Unfortunately, many motorcycle manufacture's produce motorcycles that are almost exclusively electric start. The manufacturer's reason that many motorcycle riders are aging baby boomers who do not have the ability to be reasonably able to kick start a motorcycle on a regular basis. Additionally, more women than ever are taking up motorcycle riding, and many women lack the body strength to kick start a motorcycle, especially a larger one, with ease. Therefore, the electric starting system for motorcycles is dominant in the marketplace.

What is needed is a way for a motorcycle rider to be able to kick start a motorcycle with relative ease, irrespective of physical strength or kick starting ability. This will allow most riders, young and old, small and large, men and women, to be able to enjoy the prestige of kick starting a motorcycle and to feel like a true rider. A system that allows for easy kick starting of a motorcycle must be relatively simple in design and construction and must be easy to use by the rider. The system must work with existing motorcycle systems.

SUMMARY OF THE INVENTION

The kick starter assist system of the present invention addresses the aforementioned concerns in the art. The kick starter assist system works with a motorcycle's electric starting system such that the use of the motorcycle's kick starter activates the electric starting system in order to start the motorcycle. The system requires that only a small force be used with the kick starter relative to a standard kick starter in order to start the motorcycle. The kick starter assist system can be effectively used by most riders including riders that are not very large, and female riders of all sizes. The kick starter assist system allows a rider to enjoy the fun and prestige of kick starting a motorcycle of any size without the need to have substantial body size and strength. The system reduces the amperage draw on the battery of the motorcycle when staring the motorcycle, allowing for a relatively smaller battery to be employed on the motorcycle. The system is of relatively simple design and operation and is easy to use.

The kick starter assist system is used for an electrical starter of a motorcycle engine having an electrical source and an ignition coil, the assist system comprises a controller electrically coupled to the electrical starter and a sensor for sensing engine rotation. Upon sensing engine rotation, the sensor sends a signal to the controller, wherein the controller sends a signal to the electrical starter for activating the electrical starter for starting the engine. A switch is disposed between the electrical source and the controller for turning the system on and off. The electrical starter comprises a starter relay, a starter solenoid electrically coupled to the starter relay, and a starter motor mechanically coupled to the starter solenoid and to the engine. Upon receipt of a signal from the controller, the starter relay activates the starter solenoid, which activates the starter motor, which activates the engine. The sensor can comprise a Hall effect transducer that is electrically coupled to an ignition coil of the engine and that detects a potential change on a negative lead of the ignition coil and upon such potential change, sends the signal to the controller, an optical sensor that is optically coupled or a magnetic sensor that is magnetically coupled to the kick starter subassembly to detect engine rotation occasioned by kick starter use, and upon sensing of engine rotation sends a signal to the controller, etc. The engine rotation is occasioned by a kick starter. The controller is connected to the neutral indicator switch of the motorcycle for added safety.

BRIEF DESCRIPTION OF THE DRAWINGS

Similar reference numerals refer to similar parts throughout the several views of the drawings.

DESCRIPTION OF THE PREFERRED EMBODIMENT

Figure 1:
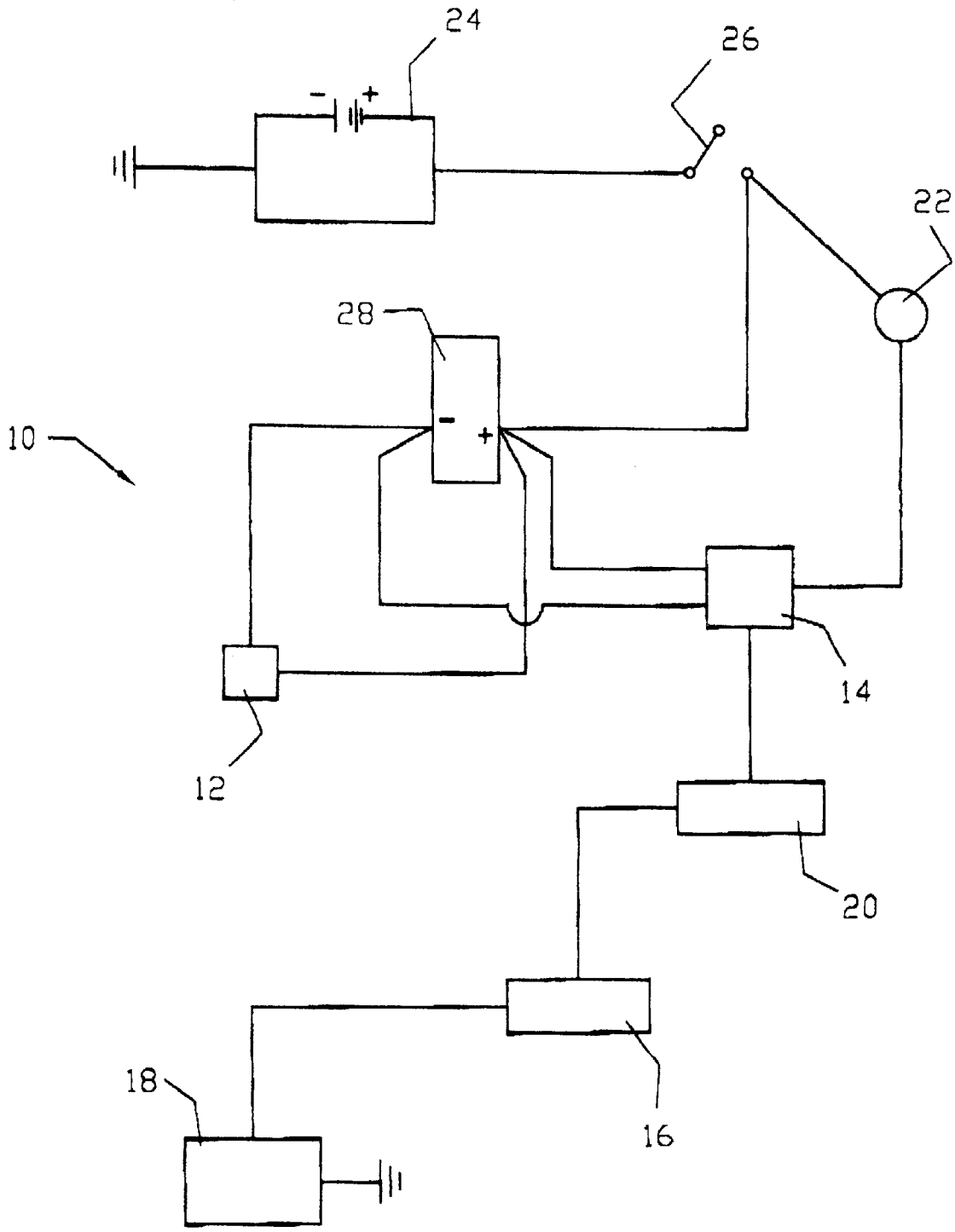
FIG. 1 is a schematic diagram of the kick start assist system of the present invention.

Referring now to the drawings, it is seen that the kick starter assist system, generally denoted by reference numeral 10, is comprised of a sensor system 12 that interacts with a controller 14. In a typical electric starter motorcycle starting system, a starter solenoid 16 is connected to the starter motor 18. Activation of the solenoid 16 causes the starter motor 18 to be turned over thereby staring the motorcycle engine. A starter relay 20 is used to control operation of the starter solenoid 16. A start button 22 is used to send a signal to the starter relay 20 in order for the relay 20 to activate the starter solenoid 16 and thus the starter motor 18 and thus the motorcycle engine. The start button 22 is electrically connected to the motorcycle's battery 24 with an ignition switch 26 interposed between the start button 22 and the battery 24 for establishing and disestablishing electrical communication between the start button 22 and the battery 24. A rider mounts the motorcycle and turns the ignition switch 26 to the on position. The rider presses the start button 22 which, by sending a signal to the starter relay 20 causes the starter solenoid 16 to activate which causes the starter motor 18 to activate, which starts the motorcycle's engine. The rider is free to ride the motorcycle as desired.

The kick starter assist system 10 of the present invention Introduces a sensor 12 and a controller 14 into the electrical starting system of the motorcycle. Additionally, a kick starter (not illustrated) of any design known in the art is mechanically attached to the motorcycle such that using the kick starter—thrusting downwardly on the kick starter—causes rotation of the motorcycle engine. The controller 14 is electrically connected to the starter relay 20 of the electric starting system of the motorcycle. The sensor 12 is electrically-connected to the controller 14 and is designed to sense motorcycle engine rotation. Once the sensor 12 senses that the engine is rotating, the sensor 12 sends a signal to the controller 14 which in turn sends a signal to the starter relay 20 which in turn activates the starter solenoid 16, which in turn activates the starter motor 18 which starts the motorcycle engine. Therefore, a rider mounts the motorcycle and turns the ignition switch 26 to the on position. The rider then uses the installed kick starter in order to turn the engine of the motorcycle. The sensor 12 sensing that the motorcycle's engine is rotating, sends a signal to the controller 14 which in turn sends a signal to the starter relay 20 which in turn activates the starter solenoid 16, which in turn activates the starter motor 18 which starts the motorcycle engine. Accordingly, the rider is required to use a relatively small force on the kick starter, that force that is required to turn the engine over as opposed to the force required to actually start the engine via the kick starter, in order to assist the electrical starting system of the motorcycle to kick in and electrically start the motorcycle's engine. As the rider is causing the engine to turn via the kick starter prior to the motorcycle's electrical system kicking in and starting the engine, the electrical starting system will have a smaller amperage draw on the battery 24 relative to the draw required without the kick starter assist system 10 being employed.

The sensor 12 that senses engine rotation can be any appropriate sensor known in the art. As illustrated, the sensor 12 can be a Hall effect transducer wherein the positive side of the battery 24 is connected to the; positive lead of the sensor 12 as well as the positive lead of the ignition coil 28 of the motorcycle, and the negative lead of the sensor 12 is connected to the negative lead of the ignition coil 28. As the kick starter causes rotation of the motorcycle engine, the ignition coil 28 causes a spark plug within the engine to fire. The sensor 12 detects the change of potential necessary for the spark plug firing on the negative lead of the ignition coil 28 and the detection of this change of potential causes the sensor 12 to deliver a signal to the controller 14 which in turn fires the starter relay 20, which in turn activates the starter solenoid 16, which in turn fires the starter motor 18, which in turn fires the engine. Alternately, the sensor 12 can be an optical sensor that is optically coupled or a magnetic sensor that is magnetically coupled to the-kick starter subassembly to detect engine rotation occasioned by kick starter use, and upon sensing of engine rotation sends a signal to the controller, or the sensor can be any other appropriate sensing device that detects engine movement, which movement is caused by the kick starter moving the engine and which dictates that the electrical starting system of the motorcycle be energized in order to start the motorcycle.

The rider may want to rotate the motorcycle engine via the kick starter until the engine is at the start of the compression stroke. This will help minimize the amount of engine rotation that is necessitated by the kick starter and will thus minimize the amount of force necessary to impart on the kick starter.

The controller 14 is designed such that the start button 22 of the motorcycle continues to be in direct electrical communication with the starter relay 20 so that the rider can ignore the kick starter and simply use the start button 22 to start the motorcycle's engine.

The controller 14 is electrically connected to the neutral indicator-switch such that the controller 14 is grounded only when the transmission of the motorcycle is in neutral. If the transmission is engaged in a gear, the kick starter assist system 10 is disabled and is incapable of starting the motorcycle's engine. This design feature serves as a safety feature. If a mechanic raises the motorcycle off of the floor and turns the rear wheel, the turning of the rear wheel causes the engine to turn. If the kick start assist system 10 of the present invention is operational, the system 10 while cause the motorcycle engine to turn on. If the motorcycle is engaged in a gear, serious injury can befall a person working on the rear portion of the motorcycle. Therefore, by connecting the controller 14 to the neutral indicator switch of the motorcycle, the kick starter assist system 10 will only start a motorcycle that is in neutral and any inadvertent motorcycle starts will not result injury to a mechanic or other person engaged with the motorcycle.

While the invention has been particularly shown and described with reference to an embodiment thereof, it will be appreciated by those skilled in the art that various changes in form and detail may be made without departing from the spirit and scope of the invention.

We claim:

1. An assist system for an electrical starter of an engine, the electrical starter comprising a starter motor subsystem and an electrical source, the assist system comprising:

a controller electrically coupled to the starter motor subsystem;

a sensor for sensing engine rotation;

and wherein upon sensing engine rotation, the sensor sends a signal to the controller wherein the controller sends a signal to the starter motor subsystem for activating the starter motor subsystem for starting the engine.

2. The assist system as in claim 1 further comprising a switch disposed between the electrical source and the controller.

3. The assist system as in claim 1 wherein the starter motor subsystem comprises:

a starter relay;

a starter solenoid electrically coupled to the starter relay;

a starter motor mechanically coupled to the starter solenoid and to the engine;

and wherein upon receipt of a signal from the controller, the starter relay activates the starter solenoid, which activates the starter motor, which activates the engine.

4. The assist system as in claim 1 wherein the sensor comprises a Hall effect transducer that is electrically coupled an ignition coil of the engine and that detects a potential change on a negative lead of the ignition coil and upon such potential change sends the signal to the controller.

5. The assist system as in claim 1 wherein the sensor comprises an optical sensor that is optically coupled to a spark plug of the engine and optical sensor detects a spark across the spark plug, and upon detecting the spark, sends the signal to the controller.

6. The assist system as in claim 1 wherein the engine rotation is occasioned by a kick starter.

7. The assist system as in claim 1 wherein the engine is disposed within a motorcycle and the controller is connected to the neutral indicator switch of the motorcycle.

8. An assist system for an electrical starter of a motorcycle engine having an electrical source and an ignition coil, the assist system comprising:

a controller electrically coupled to the electrical starter;

a sensor for sensing engine rotation;

and wherein upon sensing engine rotation, the sensor sends a signal to the controller wherein the controller sends a signal to the electrical starter for activating the electrical'starter for starting the engine.

9. The assist system as in claim 8 further comprising a switch disposed between the electrical source and the controller.

10. The assist system as in claim 8 wherein the electrical starter comprises:

a starter relay;

a starter solenoid electrically coupled to the starter relay;

a starter motor mechanically coupled to the-starter solenoid and to the engine;

and wherein upon receipt of a signal from the controller, the starter relay activates the starter solenoid, which activates the starter motor, which activates the engine.

11. The assist system as in claim 8 wherein the sensor comprises a Hall effect transducer that is electrically coupled an ignition coil of the engine and that detects a potential change on a negative lead of the ignition coil and upon such potential change sends the signal to the controller.

12. The assist system as in claim 8 wherein the sensor comprises an optical sensor that is optically coupled a spark plug of the engine, and the optical sensor detects a spark across the spark plug, and upon detecting the spark, sends the signal to the controller.

13. The assist system as in claim 8 wherein the engine rotation occasioned by a kick starter.

14. The assist system as in claim 8 wherein controller is connected to a neutral indicator switch of the motorcycle.

* * * * *